US005549460A

United States Patent [19]

O'Leary

[11] Patent Number: 5,549,460

[45] Date of Patent: Aug. 27, 1996

[54] IV FLUID DELIVERY SYSTEM

[75] Inventor: Stephen H. O'Leary, Encinitas, Calif.

[73] Assignee: IVAC Corporation, San Diego, Calif.

[21] Appl. No.: 287,625

[22] Filed: Aug. 8, 1994

[51] Int. Cl.[6] ..... F04B 43/12

[52] U.S. Cl. ..... 417/474; 604/153

[58] Field of Search ..... 417/474, 478, 417/479; 604/153

[56] References Cited

U.S. PATENT DOCUMENTS

| | | | |
|---|---|---|---|
| 2,105,200 | 1/1938 | Phelps | 128/230 |
| 2,351,828 | 6/1944 | Marsh | 103/148 |
| 2,412,397 | 12/1946 | Harper | 103/148 |
| 3,083,647 | 4/1963 | Muller | 103/128 |
| 3,314,371 | 4/1967 | Hopkinson | 103/148 |
| 3,433,171 | 3/1969 | Corneil | 417/474 |
| 3,518,033 | 6/1970 | Anderson | 417/478 |
| 3,606,596 | 9/1971 | Edwards | 417/479 |
| 4,039,269 | 8/1977 | Pickering | 417/475 |
| 4,137,940 | 2/1979 | Faisandier | 137/486 |
| 4,199,307 | 4/1980 | Jassawalla | 417/474 |
| 4,236,880 | 12/1980 | Archibald | 417/478 |
| 4,273,121 | 6/1981 | Jassawalla | 128/214 |
| 4,277,226 | 7/1981 | Archibald | 417/38 |
| 4,302,164 | 11/1981 | Manella | 417/474 |
| 4,303,376 | 12/1981 | Slekmann | 417/360 |
| 4,410,322 | 10/1983 | Archibald | 604/153 |
| 4,479,797 | 10/1984 | Kobayashi et al. | 604/153 |
| 4,519,792 | 5/1985 | Dawe | 604/152 |
| 4,559,038 | 12/1985 | Berg et al. | 604/153 |
| 4,561,830 | 12/1985 | Bradley | 417/474 |
| 4,657,490 | 4/1987 | Abbott | 417/478 |
| 4,893,991 | 1/1990 | Hemingway et al. | 417/53 |
| 4,952,124 | 8/1990 | Ogami | 417/474 |
| 4,967,940 | 11/1990 | Blette et al. | 222/214 |
| 5,055,013 | 8/1991 | Faeser | 417/474 |
| 5,056,992 | 10/1991 | Simons et al. | 417/474 |
| 5,092,749 | 3/1992 | Meiser | 417/479 |
| 5,116,203 | 5/1992 | Natwick et al. | 417/474 |
| 5,151,019 | 9/1992 | Danby et al. | 417/474 |
| 5,152,680 | 10/1992 | Okada | 417/474 |
| 5,165,873 | 11/1992 | Meiser | 417/474 |
| 5,199,852 | 4/1993 | Danby | 417/26 |
| 5,217,355 | 6/1993 | Hyman et al. | 417/474 |
| 5,302,093 | 4/1994 | Owens et al. | 417/474 |
| 5,320,502 | 6/1994 | Davis | 417/474 |
| 5,320,503 | 6/1994 | Davis | 417/474 |
| 5,322,422 | 6/1994 | Natwick et al. | 417/474 |
| 7,653,987 | 3/1987 | Tsuji et al. | 417/474 |

OTHER PUBLICATIONS

Copending U.S. application No. 08/287,624 filed Aug. 8, 1994.

Copending U.S. application No. 08/287,853, filed Aug. 8, 1994.

Copending U.S. application No. 08/287,854, filed Aug. 8, 1994.

*Primary Examiner*—Peter Korytnyk

*Attorney, Agent, or Firm*—Fulwider Patton Lee & Utecht

[57] ABSTRACT

An IV fluid delivery system for use with a resilient, deformable tube, wherein a mechanism is provided to restore the cross-sectional shape of the tube after it has been deformed by a plurality of pinchers, so as to improve the accuracy, consistency, reliability and predictability of flow through the tube.

18 Claims, 5 Drawing Sheets

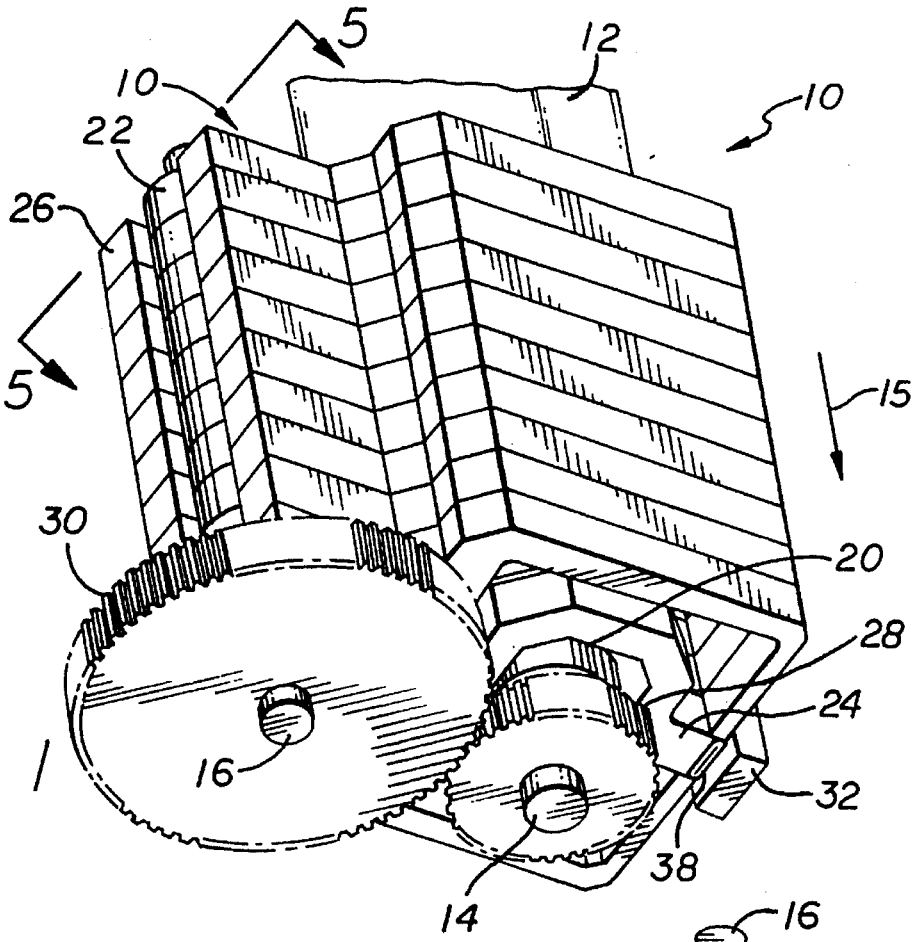
FIG. 1
FIG. 2
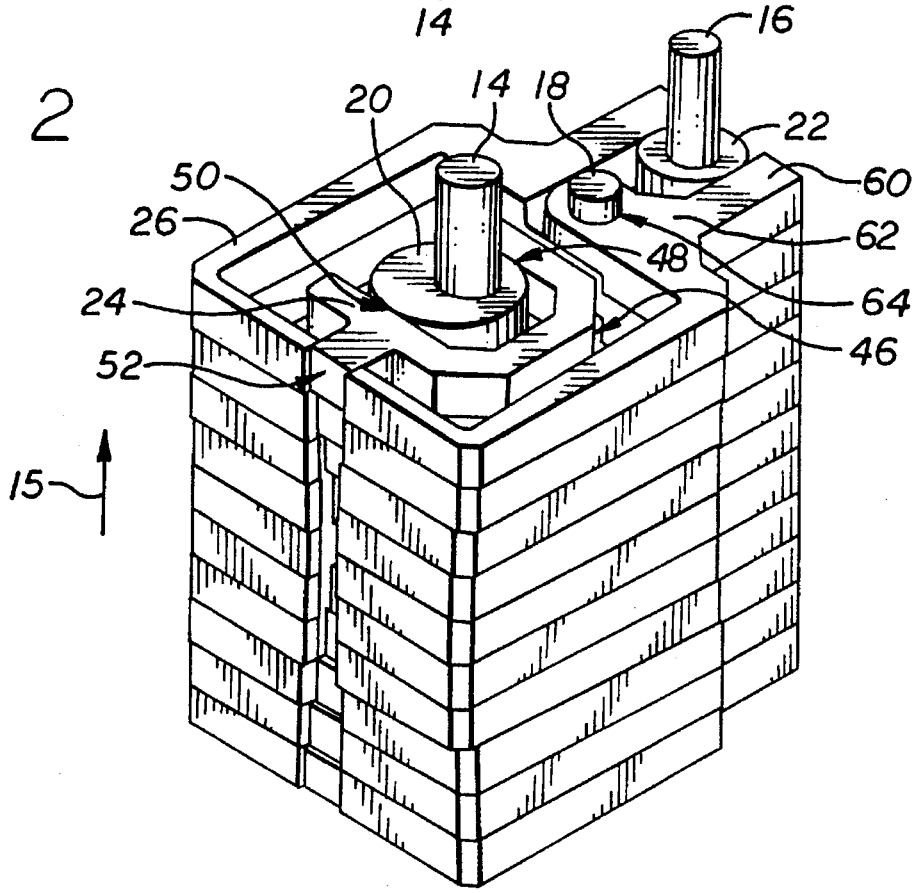

IV FLUID DELIVERY SYSTEM

BACKGROUND OF THE INVENTION

This invention generally relates to fluid delivery system that are used to administer medical solutions to patients intravenously. More specifically, the invention relates to intravenous (IV) pumps with a mechanism for improving the predictability, consistency, reliability, and accuracy of fluid flow.

Physicians and other medical personnel apply IV infusion therapy to treat various medical complications in patients. For safety reasons and in order to achieve optimal results, it is desirable to administer the IV fluid in accurate amounts as prescribed by the physician and in a controlled fashion. Certain IV delivery systems use a simple arrangement, whereby the IV fluid flows from an elevated reservoir via a length of flexible tubing connected by a catheter or the like to the patient's vascular system. In these systems, a manually adjustable clamp is used to apply pressure on the tubing to control the cross-sectional area of the tube opening to thereby control the flow rate. However, due to factors such as temperature changes which can affect the shape of the tubing, and the unpredictability of the interaction between the tubing and the clamp, such systems have not proven to be very accurate in controlling and maintaining a prescribed fluid flow rate over an extended period of time. Moreover, delivery pressure is limited in a practical sense by the head height of the fluid source and, in many instances, a greater delivery pressure is required to accomplish the desired IV infusion to the patient.

Over the years, various devices and methods have been developed to improve the administration of IV fluids under positive pressure in a controlled and accurate fashion. One such example can be found in peristaltic pumps which act on a portion of the tubing carrying the IV fluid between a fluid reservoir and the patient to deliver fluid under pressure and to control the flow rate. More specifically, a peristaltic pump is a mechanical device that pumps the fluid in a wave-like pattern by sequential deformation and occlusion of several points along the length of the resilient, deformable tubing which carries the IV fluid. Operation of such a pump typically involves a mechanical interaction between a portion of the resilient, deformable tubing, a peristaltic mechanism (i.e., mechanism capable of creating a wave-like deformation along the tube), a pressure pad for supporting the tube, and a drive mechanism for operating the peristaltic mechanism.

In such a system, the tubing is placed between the peristaltic mechanism and the pressure pad so that the peristaltic mechanism can sequentially deform and create a moving zone of occlusion along the portion of the tube. The speed of the drive mechanism may be adjusted to control the pumping cycle and to achieve the desired flow rate. As known by those skilled in the art, peristaltic pumps have provided a major improvement over older methods in achieving consistency and accuracy in the flow rate of the IV fluid.

It has been found desirable to increase the uniformity of the fluid flow rate and one factor that directly affects fluid flow in a peristaltic pump is the cross-sectional area of the tube lumen or opening. Generally, IV sets that are used with peristaltic pumps have resilient, deformable tubes (typically made of PVC) with circular cross sections, although other shapes may also be used. In order to provide further control over the flow rate, it is desirable to maintain the original cross-sectional area of the tube.

In many of the above mechanisms, after a portion of the tube is deformed under the force of the peristaltic mechanism and the peristaltic mechanism is no longer providing force against the tube, the mechanism relies on the fluid that is under pressure to assist the deformed tube to open up as well as on the elastic nature of the tube to restore its shape to the undeformed state. However, as the portion of the tube that interacts with the peristaltic pump is repeatedly deformed between the pressure pad and the peristaltic mechanism, the resiliency of the tube can be compromised and instead of the tube restoring itself to its original shape after each deformation, a non-elastic deformation of the tube may occur. While there are tubes that exhibit various degrees of resiliency, even the IV sets with highly resilient tubes, which typically are more expensive and may have to be custom made, may experience a short-term or long-term deformation as a result of counter forces exerted on the tube by the peristaltic mechanism and the pressure pad. Such a deformation may occur despite efforts to design and manufacture the components of the pump with appropriate tolerances for relieving excessive forces that may be generated between various components of the pump. An effect of such deformation of the tube is that it generally alters the cross-sectional area of the tube lumen and may reduce the amount of fluid flow to the patient per each occlusion of the tube by the peristaltic mechanism. As can be appreciated by those skilled in the art, such an occurrence is undesirable.

Also, in many of the previously designed pump mechanisms, the deformation of the tube between the peristaltic mechanism and the pressure pad occurs from the same directions throughout the operation of the pump. Such a design may increase the possibility of creating a permanent deformation in the tube.

Thus, there is a need for a peristaltic IV pump with a mechanism that substantially restores the shape of the tube to reduce the possibility of permanent deformation and change in the cross-sectional area of the inner lumen of the tube. Such a pump mechanism would enhance the accuracy, reliability, consistency, and predictability of fluid flow. The present invention fulfills these needs.

SUMMARY OF THE INVENTION

Briefly, and in general terms, the present invention is directed to a fluid delivery pump with a mechanism that alternatingly occludes and releases a portion of a resilient, deformable IV tube that carries IV fluid to the patient, and more particularly to such a pump with a mechanism for improving the predictability, consistency, reliability, and accuracy of the fluid flow rate through the IV tube and extending the useful life of the tube. After each deformation and occlusion of the portion of the tube that is engaged with the pump, the mechanism incorporated in the pump of the invention urges the previously occluded portion of the tube to substantially restore its cross-sectional shape during the operation of the pump. By urging the restoration of the shape-of the tube, the mechanism of the present invention serves to provide a consistent lumen size in the tube, so that the volume of fluid displaced by each pumping cycle remains substantially constant over time.

More specifically, a peristaltic pump in accordance with the present invention includes a plurality of pinchers and a plurality of restoring fingers that are respectively driven by rotating pincher cams and finger cams positioned along separate cam shafts. After each pincher deforms and occludes a portion of the IV tube against a pressure pad, the pincher retracts and releases the resilient IV tubing. Despite its resiliency, after repeated deformations, the IV tube does not quickly or fully return back to assume its pre-deformed shape. In order to assist the IV tube in doing so, a pair of restoring fingers with opposite facing restoring surfaces contact the same deformed portion of the tube and apply force thereon from opposite sides. After substantially restoring the shape of the tube, the restoring finger pair then retracts and allows the pincher to deform and occlude the IV tube once again. This relative motion of pinchers and restoring finger pairs takes place in a peristaltic fashion by a plurality of pinchers and corresponding restoring finger pairs so that a wave-like deformation and subsequent restoration of the tube occurs along the portion of its length that is engaged with the pump.

In one aspect of the invention, the rotation of the cams is caused by a drive mechanism that is operatively connected to a pair of interlocking gears; a pincher cam gear mounted on the pincher cam shaft and a finger cam gear mounted on the finger cam shaft. The relative motion of the pincher and restoring finger pairs are synchronized by choosing a proper gear ratio between the interlocking gears and by appropriately orienting the finger cams relative to the pincher cams. As a result of the synchronization, each pair of restoring fingers retracts from the tube before the corresponding pincher advances toward the tube, and vice versa.

In another aspect of the invention, the wave-like motion of the pincher and restoring fingers is achieved by orienting the pincher and finger cam series such that each cam is phased an appropriate number of degrees from the adjacent cam in each series. This allows the motion of pinchers and restoring fingers to be phased throughout the pumping cycle.

In yet another aspect of the invention, the pressure pad against which the tube is occluded by the pinchers, is preferably incorporated in a door which is connected to the pump frame, and is opened in order to load the resilient tube therein. The pressure pad includes tubing guides at both ends to aid in aligning the tube under the pinchers during the loading of the tube into the pump. However, because the presence of opposite facing restoring fingers on either side of the tube will maintain the tube centered under the pinchers, there is no need for a tubing guide in the middle area of the pressure pad or between the pinchers, as in many other peristaltic pump mechanisms. The tubing guides also act as stops against a surface of a support structure that supports the cam shafts and guides the movement of the pinchers. In this fashion, the pressure pad is prevented from contacting the restoring fingers when there is no tubing present.

In addition, in order to relieve excessive forces that may be applied on the tube between the pinchers and the pad, the pressure pad is preferably spring-loaded toward the pinchers by a mechanism that does not interfere with the loading and unloading of the tube. Furthermore, the pump is designed so that when the restoring fingers are in their fully advanced position, they will leave a gap that is about as wide as the original diameter of the tube. This gap will assure that the restoring fingers will not interfere with the loading of the tube.

A peristaltic pump in accordance with the present invention can be economically designed and manufactured, because many of its constituent components are identically shaped (although differently arranged). For example, all the restoring fingers are identical, all the pinchers are identical, all the finger cams are identical, all the pincher cams are identical, and the cam shafts could be identical. Furthermore, the pump of the invention serves to extend the useful life of the IV tube for administering fluids to the patient as well as enabling a physician to achieve an accurate and consistent fluid flow. Although the tubing used in IV sets typically possess resilient characteristics, their performance in peristaltic pumps can be advantageously enhanced by the mechanism of the invention which is designed to restore the shape of the tubing during the pumping operation. The restoration capability of the pump of the invention serves to prevent short or long-term deformation of the tube which can cause an unpredictable or inconsistent fluid flow over a period of time. The tube restoring mechanism of the invention can also cause the tube to be restored more quickly than it would on its own, thus enabling fluid to be pumped at higher flow rates. These and other advantages of the invention will become more apparent from the following detailed description thereof, taken in conjunction with the accompanying exemplary drawings.

BRIEF DESCRIPTION OF THE DRAWINGS

FIG. 1 is a top perspective view of a pump mechanism embodying the present invention.

FIG. 2 is a bottom perspective view of the pump mechanism shown in FIG. 1 with certain components removed for better viewing of the remaining components.

DETAILED DESCRIPTION OF THE PREFERRED EMBODIMENT

Figure 3:
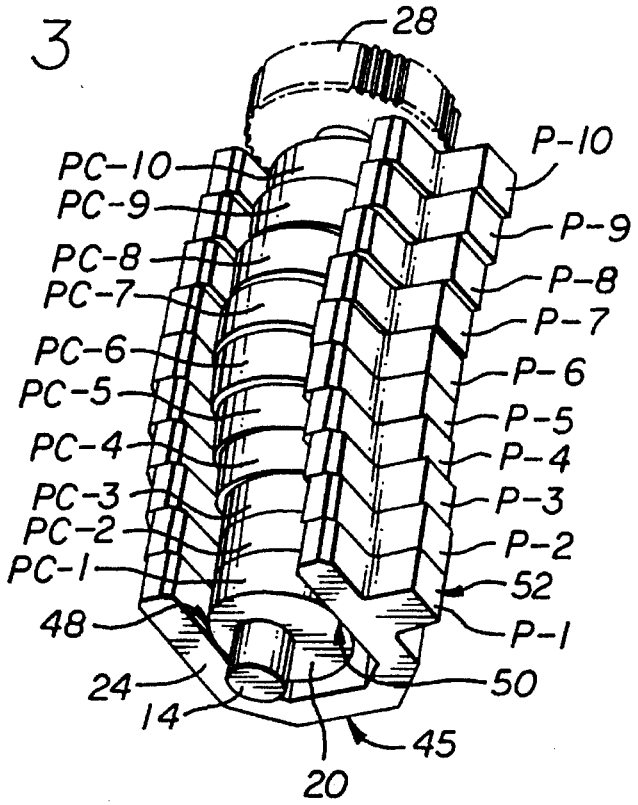
FIG. 3 is a bottom perspective view of a certain internal structure of the pump mechanism shown in FIG. 1, namely the pinchers.

The present invention is embodied in a pump mechanism 10 as illustrated in FIGS. 1 and 2. The pump mechanism 10 generally includes a plurality of pinchers 24 that sequentially apply force to deform and occlude a portion of a resilient, deformable IV tube 38 that carries IV fluid from an elevated fluid reservoir to a patient (fluid reservoir and the patient not shown), a plurality of opposite facing restoring fingers 26 that apply a restoring force on the portion of the tube 38, and a motor 12 that supplies the driving force for the movement of the pinchers 24 and the restoring fingers 26.

In operation, a portion of the tube 38 is placed in the pump mechanism 10 between a pressure pad 32 and the pinchers 24. After each pincher 24 moves downward to deform and occlude the tube 38, it then retracts upward and releases the tube and makes room for one pair of the opposite facing restoring fingers 26 which move in transverse directions with respect to the length of the tube. The restoring finger pair 26 then applies force from opposite directions so as to aid the tube in restoring its cross sectional area back to its pre-occluded condition. Thereafter, the restoring finger pair 26 retracts, and the pincher 24 advances and occludes the same portion of the tube once again. This cycle is repeated in a wave-like fashion by the plurality of the pinchers 24 and the restoring fingers 26 along the length of the tube 38 that is engaged with the pump mechanism.

In more detail, as shown in FIG. 1, a pincher cam shaft 14 is operatively connected to the motor 12 which is preferably a stepper motor, however, other means that may result in the rotation of the pincher cam shaft may be used. A finger cam shaft 16 is longitudinally parallel to and is positioned above the pincher cam shaft 14, and is operatively engaged with the pincher cam shaft through an interlocking connection between a pincher cam gear 28 and a finger cam gear 30. The motor 12 could alternatively be connected to the finger cam shaft 16. The motor may also have a pinioned shaft that engages either of the cam gears 28 or 30. Also, alternatively, the interlocking pincher cam gear 28 and finger cam gear 30 could be replaced by belt driven pulleys (not shown) as known by those skilled in the art. The pincher cam gear 28 and the finger cam gear 30 are respectively mounted on one end of the pincher cam shaft 14 and the finger cam shaft 16, as for example on their downstream ends (see arrow 15 pointing to the downstream direction of fluid flow) as shown in FIG. 1. The interlocking arrangement of the gears will force the finger cam shaft 16 to rotate in the opposite direction of the pincher cam shaft.

The pincher cam gear 28 and the finger cam gear 30 are preferably designed with a 2:1 gear ratio with the pincher cam shaft 14 making one full rotation and the finger cam shaft 16 making one-half rotation per pump cycle. Also, a different gear ratio (e.g., a 1:1 gear ratio) may be selected, however, this would require twice as many cams to perform the operation of the pump; i.e., one cam for acting on each opposing finger in a restoring finger pair. As will be described below, the 2:1 gear ratio synchronizes the movement of the pinchers 24 and the restoring fingers 26.

A plurality of pincher cams 20 are located along the pincher cam shaft 14 with one pincher 24 associated with each cam 20. In the preferred embodiment of the invention, ten pincher cams 20 are associated with ten pinchers 24, but a different number of cams and pinchers may be chosen to achieve similar results. For easy identification of each cam and pincher, as shown in FIG. 3, starting from the upstream end of the pump, the pincher cams ("PC") and the pinchers ("P") are each numbered one through ten, and designated as PC-1, PC-2, . . . , PC-10, and P-1, P-2, . . . , P-10, respectively. Each pincher 24 has an upper end 46 which contacts two opposite sides (a top side 48 and a bottom side 50) of its associated pincher cam 20 to translate the rotation of the pincher cam into an up and down movement of the pincher. The downward movement of the pincher advances a pinching surface 52 toward the tube 38, and occludes the tube in its most advanced position, while the upward movement of the pincher retracts and releases the pinching surface 52 from the tube. The wave-like up and down movement of the pinchers 24 in contact with their associated pincher cams 20 can be seen in FIG. 3 which has isolated the pincher cam gear 28, the pincher cams 20, and the pinchers 24.

Figure 4:
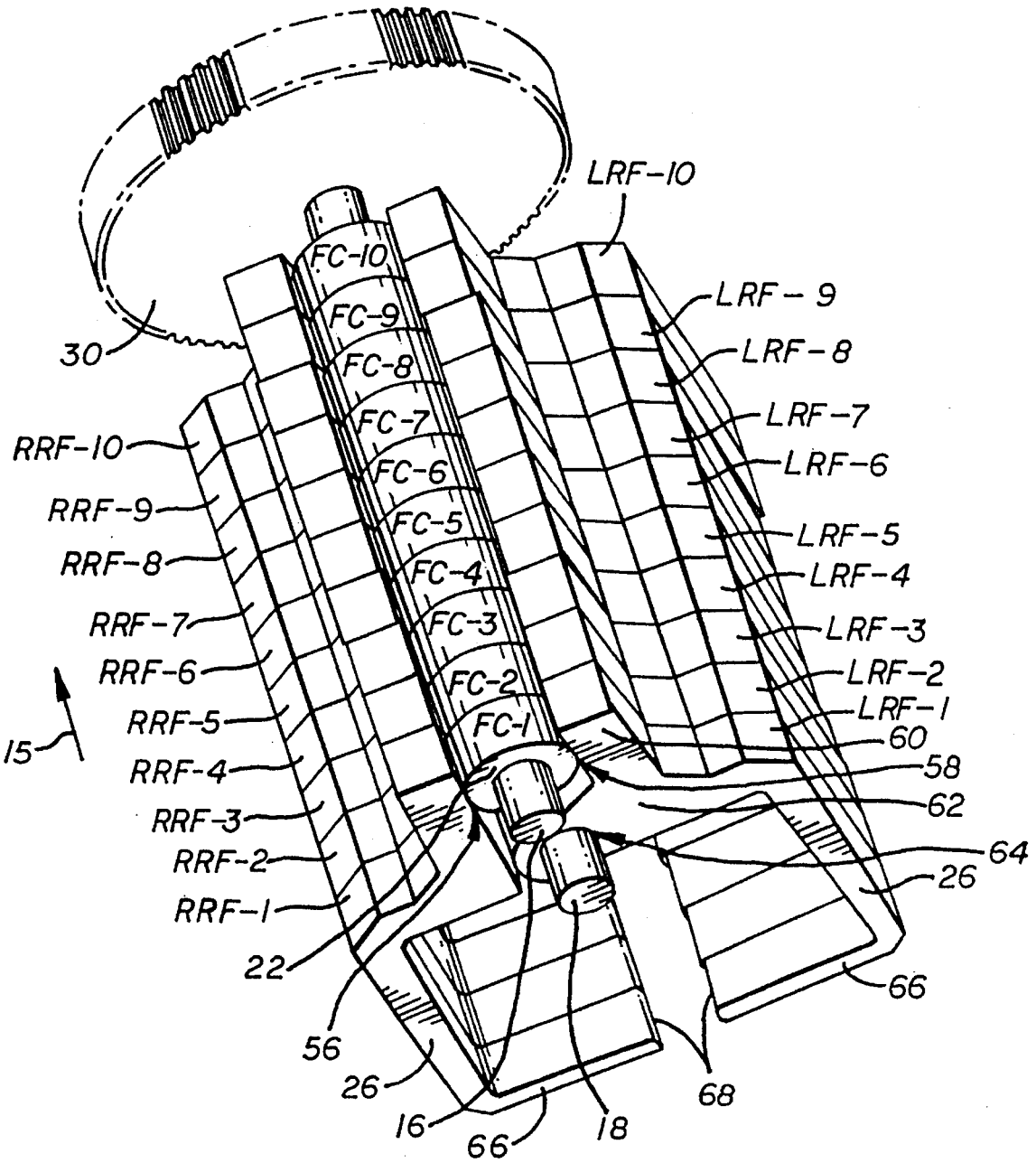
FIG. 4 is a top perspective view of another internal structure of the pump mechanism shown in FIG. 1, namely, the restoring finger pairs that surround the pinchers.

As shown in FIG. 4, a plurality of finger cams 22, equal in number to the pincher cams (ten in this case), are located along the finger cam shaft 16 which at its downstream end is connected to the finger cam gear 30 (FIG. 4 has isolated the finger cam gear 30, the finger cams 22, the restoring fingers 26, and a stationary pivot shaft 18). The restoring fingers 26 face one another and create mirror images and are placed on opposite sides (a left side 56 and a right side 58) of each finger cam 22 to create pairs of restoring fingers.

Again, for easy reference, beginning at the upstream end of the pump, the finger cams ("FC") and each pair of restoring fingers are numbered one through ten. Also, looking from the downstream end of the pump (i.e., looking in the upstream direction), the restoring fingers positioned on the right side 58 of the finger cams are referred to as "right restoring fingers" ("RRF") and those positioned on the left side 56 of the finger cams are referred to as "left restoring fingers" ("LRF"). Accordingly, as shown in FIG. 4, the finger cams are designated as FC-1, FC-2, . . . , FC-10, and the restoring fingers are designated as LRF-1, RRF-1, LRF-2, RRF-2, . . . , LRF-10, RRF-10. An upper portion 60 of each right restoring finger contacts the right side 58 of its associated finger cam 22, and the upper portion 60 of each left restoring finger contacts the left side 56 of its associated finger cam 22.

An intermediate portion 62 of each restoring finger with a round aperture 64 therein is pivotally fitted onto the stationary pivot shaft 18 that is positioned between the pincher and finger cam shafts in a longitudinally parallel orientation (see FIGS. 2 and 4). A lower portion 66 of each restoring finger terminates with a restoring surface 68 for applying force on tube 38 from opposite transverse directions, so as to aid the tube in restoring its shape (see FIG. 4). The Upper and lower portions 60 and 66 of the restoring fingers 26 are as wide as the width of the finger cams 22 (looking along the length of the finger cam shaft), while the width of the intermediate portion 62 with the round aperture 64 therein is reduced in half. The reduced width allows two opposite facing fingers in each pair to be placed side by side on the pivot shaft 18, while their upper portions 60 maintain contact with the same finger cam and their lower portions 66 act on the same axial length of the tube.

Furthermore, the finger cams 22 are positioned so that the restoring surfaces 68 of each pair of restoring fingers act on the same axial length of the tube (from opposite transverse directions) as the pinching surface 52 of their associated pincher (i.e., the number one right and left restoring fingers and the number one pincher act on one portion of the tube, the number two right and left restoring fingers and the number two pincher act on another portion of the tube adjacent to the first portion, and etc.).

Figure 5:
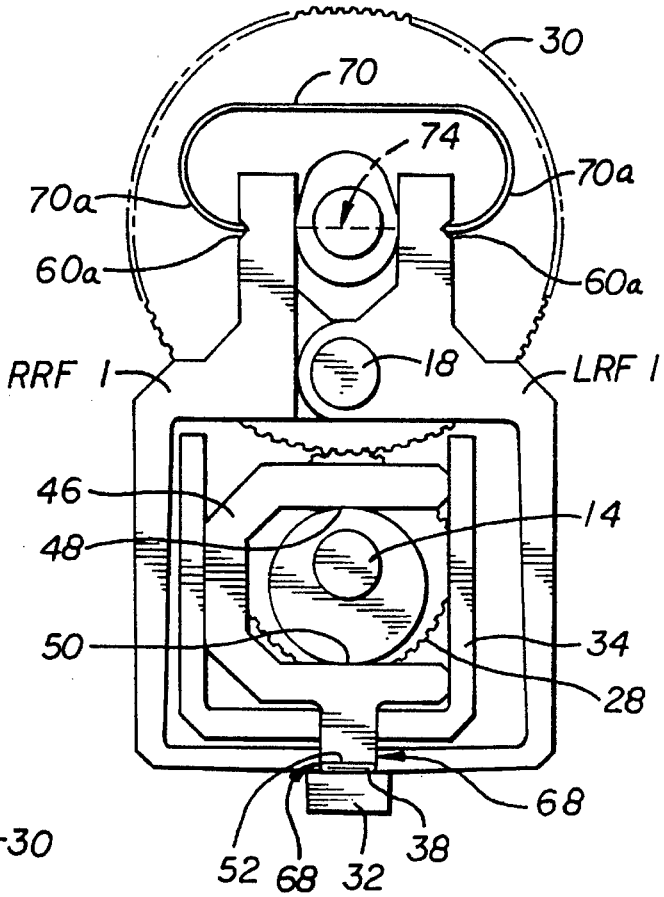
FIG. 5 is an end view, taken at line 5—5, of the pump mechanism shown in FIG. 1, showing one of the restoring finger pairs, one of the pinchers, and a cross-section of a resilient, deformable tube located under the pincher.
Figure 6:
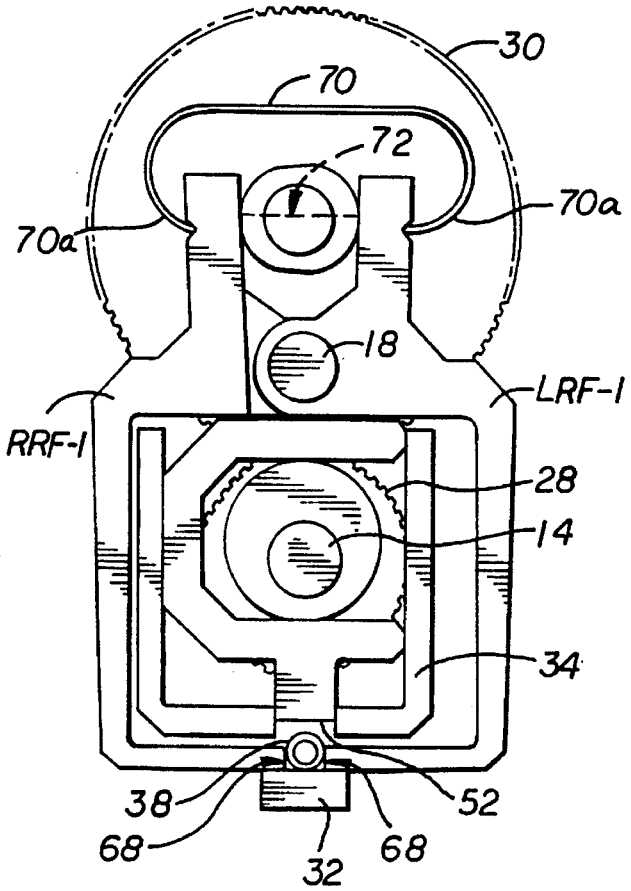
FIG. 6 is an end view similar to FIG. 5, except that certain operative parts are shown in different positions.

Each finger cam 22 is shaped to simultaneously apply equal motions on the upper portions 60 of its associated pair of restoring fingers so that both upper portions are either equally pushed away or allowed to move toward the finger cam shaft 16. To accomplish this objective, each finger cam 22 preferably has an elliptical-like profile (or other symmetrical profile) as shown in FIGS. 4–6. When contact between the tipper portions of a pair of restoring fingers and their associated finger cam occurs along a long axis 72 of the elliptical-like cam, the upper portions are pushed outward, causing the intermediate portion 62 of each restoring finger to pivot around the pivot shaft 18 which in turn advances the restoring surface 68 of the lower portions of the fingers toward the tube. The finger cams 22 are designed to advance the restoring finger pairs 26 until a gap equal to the outer diameter of the tube remains between the contact surfaces of opposing fingers.

On the other hand, when contact between a finger cam and its associated pair of restoring fingers occurs along a short axis 74 of the elliptical-like cam, the upper portions move inward, thereby resulting in the pivoting motion of the intermediate portion 62 of each finger around the pivot shaft 18 and retracting the lower portions 66 away from the tube. The retracted position of the restoring finger pairs leaves a gap between opposite restoring surfaces that would allow a pincher to enter therein and occlude the tube.

Figure 7:
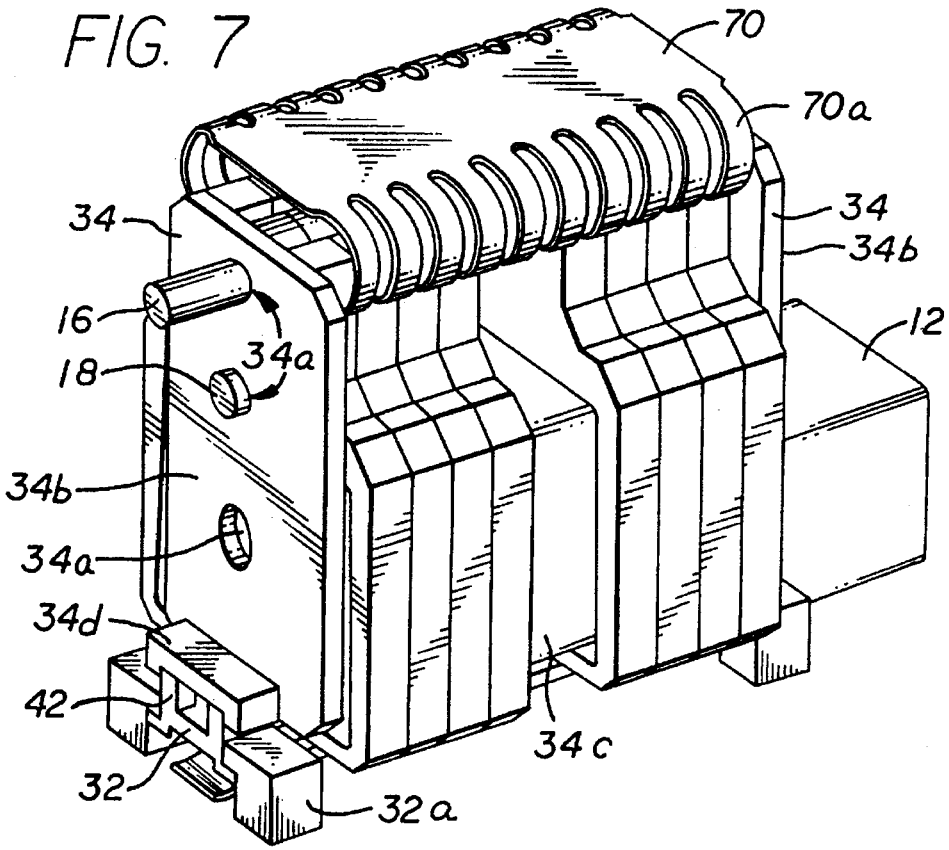
FIG. 7 is a perspective view of the pump mechanism shown in FIG. 1, except that the pump mechanism is rotated approximately 90° clockwise (relative to its orientation in FIG. 1) and certain parts are removed to enable the viewing of other parts.

Each restoring finger 26 is urged to maintain contact with its associated finger cam 22 under the influence of a biasing means such as a restoring finger biasing spring 70, whose preferred embodiment is shown in FIG. 7. Referring to FIGS. 5–7, each arm 70*a* of the restoring finger biasing spring 70 is seated in a notch 60*a* formed on the outside of the upper portion 60 of each of the restoring fingers 26. Instead of this self-aligning method, other methods may be used to engage the finger biasing spring 70 with the restoring fingers. The individually flexible nature of each arm 70*a* of the restoring finger biasing spring 70 shown in FIG. 7 allows each arm to deflect as necessary by the restoring finger that it is in contact with.

Figure 8:
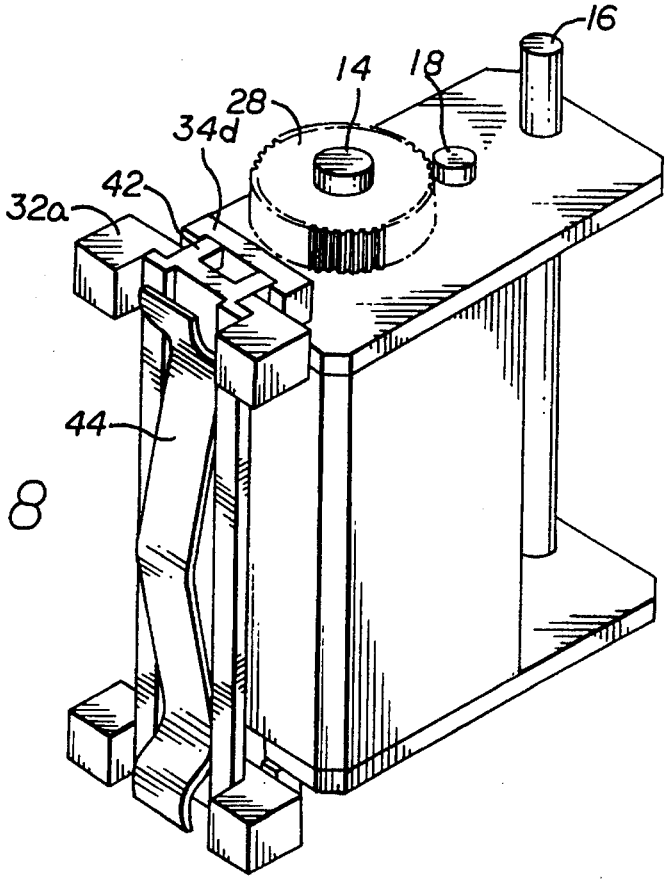
FIG. 8 is a perspective view of the pump mechanism shown in FIG. 1, except that the pump mechanism is rotated (relative to its orientation in FIG. 1) to show its underside and certain parts are removed for better clarity.
Figure 9:
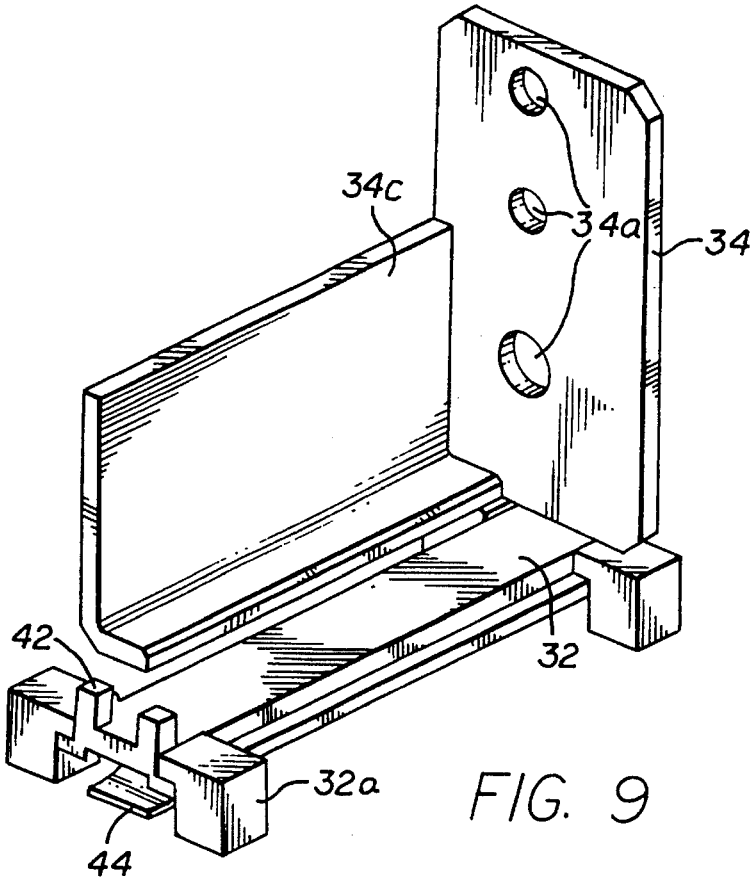
FIG. 9 is a perspective view similar to FIG. 8, except that certain parts of the pump mechanism are removed and the remaining parts are oriented in a different direction (relative to their orientation in FIG. 8) to show certain internal details.

Referring to FIGS. 7–9, a support structure 34 is provided to hold the pincher and finger cam shafts 14 and 16 and the stationary pivot shaft 18 in their respective positions. The support structure 34 has an open box-like shape with three apertures 34*a* at each of its two ends 34*b* that can accommodate the diameter of the three shafts 14, 16, 18 to provide support therefor. The support structure 34 also has two side walls 34*c* that are spaced on either side of the pinchers 24 with the spacing adapted to provide a guide for the linear up and down movement of the pinchers 24 and to maintain their proper positioning in the pump of the invention (see also FIGS. 5 and 6). The underside of the support structure 34 has an opening in the middle along its length to allow the pinchers 24 to pass therethrough and occlude the tube 38 against the pressure pad 32. Referring to FIGS. 7–8, the support structure 34 has an extended portion 34*d* on the outside of each of its two ends 34*b* that provides a stop against the pressure pad 32 such that a sufficient clearance is achieved to prevent the pressure pad 32 from contacting the restoring fingers 26 when the tube 38 has not yet been loaded in the pump mechanism, and to allow unimpeded movement of the restoring fingers 26 towards the tube 38 during the operation of the pump.

As briefly stated earlier, the IV fluid is typically carried via the tube 38 from an elevated fluid reservoir to the patient. In order to control the fluid flow, a portion of the tube 38 is placed between the pressure pad 32 and the pinchers 24 such that the tube lies a fixed distance from and is substantially parallel to the longitudinal axis of the pincher cam shaft 14 and the finger cam shaft 16. The pressure pad 32 is preferably incorporated in a door (not shown) of the pump which is opened for placing the tube between the pad and the pinchers.

With reference to FIGS. 7–9, the pressure pad 32 includes pressure pad guides 42 at each end for facilitating the alignment of the tube 38 under the peristaltic pinchers. As explained earlier, the pressure pad guides 42 also act as stops against extended portions 34*d* located on the outside of the support structure 34. The pressure pad 32 is also biased against the tube and the pinchers by a pressure pad spring 44, but the spring mechanism is designed so as not to interfere with the opening of the door in the opposite direction during the loading of the tube. As shown in FIG. 8, the preferred embodiment of the pressure pad spring 44 is a leaf spring, however, other biasing means may also be used to spring-load the pressure pad 32 against the tube 38. As can be seen in FIG. 8, the pressure pad leaf spring 44 is located between the bottom side of the pressure pad 32 and the door (not shown). The pressure pad is incorporated in the door via door-mounted retainers 32*a* that hold both ends of the pressure pad. Upon loading of a portion of the tube 38 in the pump and closing the door, a nominal gap remains between the extended portions 34*d* of the support structure 34 and the pressure pad guides 42, and between the pressure pad retainers 32*a* and the pressure pad 32.

Although the mechanism of the invention is ideally designed for a specific desirable tube diameter, tubes with slightly different diameters may be used, since the invention provides for a consistent tube restoration capability. Furthermore, the spring-loading of the pressure pad 32 allows a sufficient pinch-off force to be applied on tubes, regardless of the thickness of the tubing in the pinched-off condition. Accordingly, the mechanism of the invention accommodates the pinching of tubes with different wall thicknesses.

To illustrate the operation of pump mechanism 10 in more detail, the relative movements of the number one pincher and restoring finger pair will be described hereinafter as an example. The relationship between other pinchers and their associated restoring finger pairs are similar. With reference to FIG. 5, the upper portions 60 of the right and left number one restoring fingers are shown to contact the number one finger cam 22 along its short axis 74. As a result, the restoring surface 68 of the fingers are shown in their fully retracted position away from the tube 38. At the same time, the number one pincher cam 20 is shown in its top-dead-center position, wherein the contact between the upper end 46 of the number one pincher and the pincher cam has forced the pinching surface 52 to move to its most advanced position. As can be seen in FIG. 5, in this position, restoring finger pair number one is in its retracted position, and the pinching surface 52 has occluded the tube 38 against the pressure pad 32.

As the motor 12 continues to rotate, the pincher and finger cam shafts 14 and 16 rotate. Due to the elliptical-like profile of each finger cam, as the finger cam shaft 16 makes a one-quarter rotation, the upper portions 60 of restoring finger pair number one contact the number one finger cam along its long axis 72. This causes restoring finger pair number one to move from its fully retracted position (shown in FIG. 5) to its fully advanced position (shown in FIG. 6). At the same time, as the finger cam shaft 16 makes a one-quarter rotation, due to the 2:1 gear ratio, the pincher cam shaft 14 makes a one-half rotation. This forces pincher cam number one to move to its bottom-dead-center, wherein the pinching surface 52 of pincher number one assumes its most retracted position. This situation is depicted in FIG. 6, wherein the number one pincher 24 has moved away from the tube 38, and the restoring surfaces 68 of restoring finger pair number one have applied force on the tube and urged it to substantially restore its original shape.

As the motor 12 continues to rotate, with another one-quarter rotation of the finger cam shaft 16, the number one restoring finger pair moves to its fully retracted position. At the same time, the pincher cam shaft 14 makes a one-half rotation, resulting in the movement of pincher number one to its fully advanced position. This situation brings the number one pincher and finger pair back to their relative positions as shown in FIG. 5. Therefore, with every one full rotation of the pincher cam shaft 14 and with every one-half rotation of the finger cam shaft 16, each pincher and its associated restoring finger pair make a complete cycle and return to their previous positions.

The relative orientation of each finger cam and its associated pincher cam (e.g., the number one finger cam and the number one pincher cam) on their respective cam shafts are such that the restoring surfaces of opposite-facing fingers will assume their fully retracted position just before the pinching surface 52 passes them in its downward movement toward the tube. Also, the pincher will retract beyond the restoring surfaces 68 of the fingers before the restoring surfaces of the fingers begin their movement toward the tube. This provides the necessary clearance for corresponding pinchers and restoring finger pairs to act on the same axial length of the tube.

The profile of all the ten pincher cams 20 are identical, but each is oriented along the pincher cam shaft 14 with a thirty six degree phase angle compared to its adjacent cam (the appropriate phase angle is derived by dividing 360 by the number of cams). In a similar fashion, all the ten finger cams 22 have identical profiles (not the same as the pincher cams), and each is oriented with an eighteen degree phase angle from an adjacent finger cam. Therefore, as the pincher and finger cam shafts rotate, the pinchers and restoring finger pairs sequentially advance and retract in a wave-like fashion throughout the operation of the pump. The relationship between the positions of the ten pinchers and the ten restoring finger pairs may be seen from Table 1 which shows the degrees of pincher cam shaft rotation at which the pinchers and the restoring finger pairs are in their fully advanced positions.

TABLE 1

| | Fully Advanced Position of Pinchers and Restoring Finger Paris (Based On Degrees Of Pincher Cam Shaft Rotation) | | | | | | | | | |
|---|---|---|---|---|---|---|---|---|---|---|
| Number | 1 | 2 | 3 | 4 | 5 | 6 | 7 | 8 | 9 | 10 |
| Pincher | 0 | 36 | 72 | 108 | 144 | 180 | 216 | 252 | 288 | 324 |
| Restoring Finger Pair | 180 | 216 | 252 | 288 | 324 | 0 | 36 | 72 | 108 | 144 |

In Table 1, the position of the pincher cam shaft at which the number one pincher is in its most advanced position (where it occludes the tube) is assigned "zero degrees of rotation" as a point of reference for both the pinchers and the restoring finger pairs. For example, it can be seen from Table 1 that at zero degrees of pincher cam shaft rotation, the number one pincher is in its most advanced position, and after a 180 degree rotation of the pincher cam shaft, pincher number six will be in its most advanced position. Describing the same relationship differently, when pincher number one is in its fully advanced position, pincher number six is in its fully retracted position. The same relationship exists between pincher number two and pincher number seven, between pincher number three and pincher number eight, and etc.

As for the restoring fingers, Table 1 shows that at zero degrees of pincher cam shaft rotation, the number one restoring finger pair is in the fully retracted position, while restoring finger pair number six is in its fully advanced position, and vice versa. A similar relationship exists between the number two restoring finger pair and the number seven restoring finger pair, between the number three restoring finger pair and the number eight restoring finger pair, and etc. Table 1 also shows that when pincher number one is in the fully advanced position, restoring finger pair number one is in the fully retracted position, and vice versa. The same relationship exists between each pincher and its corresponding restoring finger pair.

For ease of comparison between the relative positions of pinchers and restoring finger pairs, the rotation of the finger cam shaft has not been introduced in Table 1, and the data is based on degrees of rotation of the pincher cam shaft. It should be kept in mind, however, that as described earlier, with every full rotation of the pincher cam shaft 14, the finger cam shaft 16 completes a one-half rotation (due to the 2:1 gear ratio). Given that the finger cams 22 are elliptical-like, the restoring finger pairs repeat their cycle with every one rotation of the pincher cam shaft and with every one-half rotation of the finger cam shaft.

From the foregoing, it will be appreciated that the present invention provides a mechanism wherein a series of pinchers deform and occlude a tube carrying IV fluid, and a series of finger pairs apply force from opposite sides of the occluded portion of the tube to assist in restoring the original shape of the tube during the operation of the pump. The restoration of the shape of the tube advantageously enhances the accuracy and reliability of the fluid flow rate, extends the useful life of the IV tubing, and allows the use of low cost IV sets.

While particular forms of the invention have been illustrated and described, it will be apparent that various modifications can be made to the present invention without departing from the spirit and the scope thereof.

What is claimed is:

1. A pump for delivery of fluid through a resilient, deformable tube, comprising:

a pressure pad;

a plurality of cams associated with a first camshaft;

a plurality of pinchers that are actively driven by the cams of said first camshaft to apply force to deform said tube against said pressure pad and are actively retracted away from said tube by the cams of said first camshaft;

a plurality of cams associated with a second cam shaft;

a plurality of restoring fingers that are actively driven by the cams of said second camshaft to apply force on said tube after deformation of said tube by said pinchers to urge said tube to restore said tube's cross-sectional area; and a motor operatively engaged with said camshafts.

2. The pump of claim 1, wherein said restoring fingers pivot about a pivot shaft.

3. The pump of claim 1, wherein said first and said second camshafts are operatively engaged with said motor through interlocking gears.

4. The pump of claim 1, wherein said restoring fingers apply force on said tube from two different directions.

5. The pump of claim 1, further comprising a biasing device engaged with said restoring fingers so that said fingers are biased to maintain contact with said cams of said second camshaft.

6. The pump of claim 1, wherein said pressure pad is biased against said tube and said pinchers.

7. The pump of claim 1, wherein said pinchers apply force on said tube to occlude said tube against said pressure pad.

8. The pump of claim 1 wherein a single cam actuates two opposing restoring fingers and said second camshaft is turned at half the speed of said first camshaft.

9. The pump of claim 1 wherein each of said pinchers includes elements that extend to opposed sides of a single cam of said first camshaft whereby said pinchers are actively driven toward and retracted from said pressure plate.

10. A pump for delivery of fluid through a resilient, deformable tube, comprising:

a pressure pad;

a plurality of cams associated with a first camshaft;

a plurality of pinchers that are actively driven by the cams of said first camshaft to apply force to deform said tube against said pressure pad and are actively retracted away from said tube by the cams of said first camshaft;

a plurality of cams associated with a second cam shaft;

a pivot shaft;

a plurality of opposing restoring fingers that are actively driven by the cams of said second camshaft to pivot about said pivot shaft and apply force from opposed directions on said tube after deformation of said tube by said pinchers to urge said tube to restore said tube's cross-sectional area; and a motor operatively engaged with said camshafts.

11. The pump of claim 10, wherein said restoring fingers are biased to maintain contact with sad second cams.

12. The pump of claim 10 wherein a single cam actuates two opposing restoring fingers.

13. The pump of claim 10 wherein said second camshaft is turned at half the speed of said first camshaft.

14. The pump of claim 10 wherein each of said pinchers includes elements that extend to opposed sides of a single cam of said first camshaft whereby said pinchers are actively driven toward and retracted from said pressure plate.

15. A pump for delivery of fluid through a resilient, deformable tube, comprising:

a pressure pad;

a plurality of cams associated with a first camshaft;

a plurality of pinchers that are actively driven by the cams of said first camshaft to apply force to deform said tube against said pressure pad and are actively retracted away from said tube by the cams of said first camshaft;

a plurality of cams associated with a second cam shaft;

a pivot shaft;

a plurality of restoring fingers that are actively driven by the cams of said second camshaft to pivot about said pivot shaft and apply force on said tube after deformation of said tube by said pinchers to urge said tube to restore said tube's cross-sectional area;

a biasing device for biasing said restoring fingers against said second camshaft; and a motor operatively engaged with said camshafts.

16. The pump of claim 15, wherein said restoring fingers are arranged in opposing pairs in order to apply force on said tube from two different directions.

17. The pump of claim 16 wherein a single cam actuates two opposing restoring fingers.

18. The pump of claim 15 wherein said second camshaft is turned at half the speed of said first camshaft.

* * * * *